US005294103A

United States Patent [19]

Chou

[11] Patent Number: 5,294,103

[45] Date of Patent: Mar. 15, 1994

[54] DOCUMENT AND DRAFT PAPER HOLDER FOR A COMPUTER

[76] Inventor: Shui-Lai Chou, No. 35-19, Hsia-Kuo Ln., Tai-Pin Rd., Ta-Li Hsiang, Taichung, Taiwan

[21] Appl. No.: 493

[22] Filed: Jan. 5, 1993

[51] Int. Cl.[5] ..... B65H 3/32; B65H 3/06

[52] U.S. Cl. ..... 271/113; 271/114; 271/121; 271/126; 271/266; 400/718

[58] Field of Search ..... 271/113, 114, 121, 126, 271/266, 275; 400/718, 718.1, 718.2

[56] References Cited

U.S. PATENT DOCUMENTS 3,450,321 6/1969 Turner et al. ..... 271/266
3,955,663 5/1976 Ecker ..... 271/266
4,175,694 11/1979 Donabin ..... 271/266
4,269,403 5/1981 Stephens et al. ..... 271/114
4,979,605 12/1990 Svyatsky ..... 271/266

*Primary Examiner*—H. Grant Skaggs
*Attorney, Agent, or Firm*—Ostrolenk, Faber, Gerb & Soffen

[57] ABSTRACT

A document and draft paper holding device for a computer, comprising a main body capable of being located beside a monitor for clamping the draft document and exposing part of the contents of the draft. A paper passing device separates and passes the paper upward to the exposing part of the holder. A driving device, activated by pushing a button, starts a pick-up roller for delivering the requested amount of paper. By pushing a button located on the monitor or nearby, part of the contents of the draft will be clearly shown in the main body of the computer for the convenience of operator, reducing typing mistakes and increasing operator efficiency.

13 Claims, 4 Drawing Sheets

DOCUMENT AND DRAFT PAPER HOLDER FOR A COMPUTER

BACKGROUND OF THE INVENTION

1. Field of the Invention

The present invention relates to a document and draft paper holder for a computer, particularly to a frame which can hold a large amount of draft paper and sequentially display the contents of the draft on a transparent part of the frame, by pushing a key on the keyboard or a button nearby.

2. Description of the Related Art

Nowadays, computers are widely used for storing and processing a great amount of data and documents. However, an operator must type the data of the document or paper. Average operators have to move their eyes back and forth between the monitor and a draft, while inputting data into the computer. However, it is a very inefficient and uneconomical operation according to the principle of Motion and Time Study, causing strain on the operator's eyes, as well as neck, and causing more typos.

For solving the above-mentioned problems, Taiwan No. 133555 discloses a document and draft holder for a computer. The holder is attached to the casing of the monitor at the same eye level. Thus, the operator does not have to move back and forth between the monitor and draft. As shown in FIG. 1, the holder is characterized by two elastic clamping plates B located on a document or draft clamping base A. Elastic clamping plates B are connected with clamping base A at one side thereof. An empty space is left between the clamping base A, and the top of clamping plates B. The drafts are inputted between the elastic clamping plate B and empty space C. Various drawbacks in the above holder are as follows:

1. The clamping base A and elastic clamping plates B are made of a single piece, therefore, the elasticity of the elastic clamping plates B is limited, i.e., the plates can't be opened and the drafts placed inside. The drafts can only be inserted between the elastic clamping plate B and through empty space C, one at a time, requiring a large amount of time to clamp and remove the drafts.

2. While a draft inputted between clamping base A and elastic clamping strap B, is fixed, the operator doesn't have any indexing device available for referencing the line they are reading, thus it is easy to duplicate, or miss an entire line, in addition to other typos.

SUMMARY OF THE INVENTION

The main object of this invention is not only for solving the deficiencies of the prior art, but also to automate the same. The present invention can:

1. Hold a plurality of drafts at the same time, in a transparent part or equivalent disposed on the main body.

2. In order not to cause the input of duplicate lines and to prevent missing lines, and also to make reading easier, as well as more efficient, the invention includes a paper delivery device for delivering the draft to the transparent part on the main body, two or more lines at one time.

3. By using the paper delivery driving device, the operator only needs to use the keyboard or to push a button nearby, to move two or more lines on the draft which is placed under the transparent part on the main body, thus, reducing labor and saving time.

A document and draft paper holding device of the present invention comprises a main body capable of being located beside a computer monitor for clamping a draft paper or document and showing part of the contents of the draft. A paper passing device separates and passes the paper. A driving device, activated by pushing a button, starts a pick-up roller to deliver a requested amount of paper. By pushing a button, on the keyboard or provided nearby, part of the contents of the draft will be clearly shown in the main body sequentially for the convenience of operator, reducing typing mistakes and thus, increasing efficiency.

DETAILED DESCRIPTION OF THE INVENTION

Figure 1:
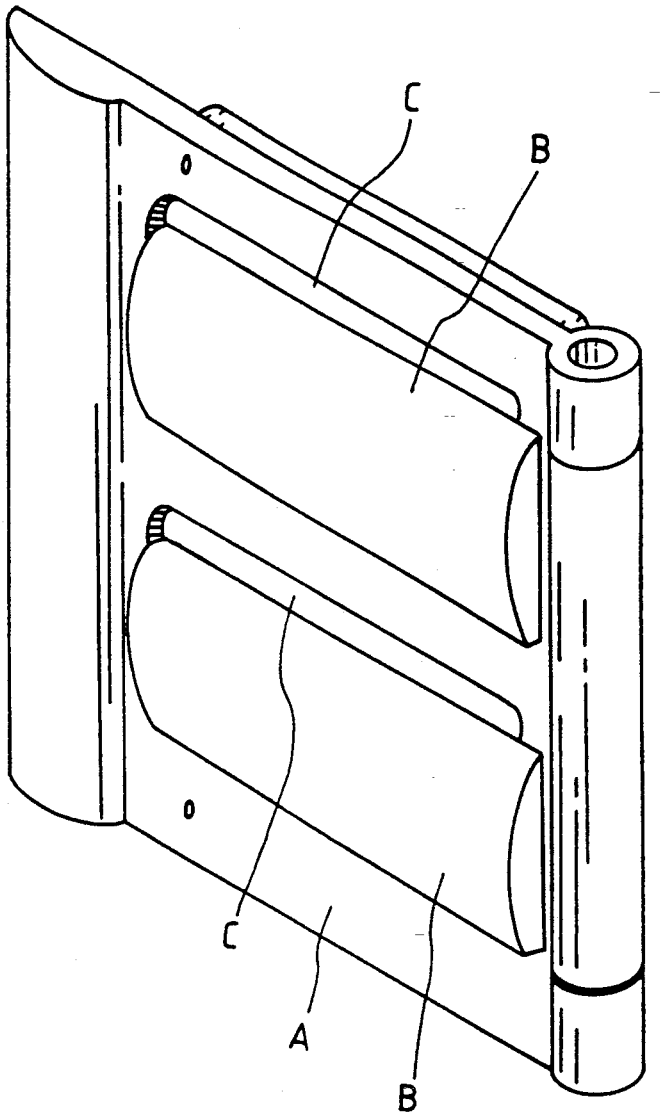
( PRIOR ART ) FIG 1
FIG. 1 shows a conventional holder.
Figure 2:
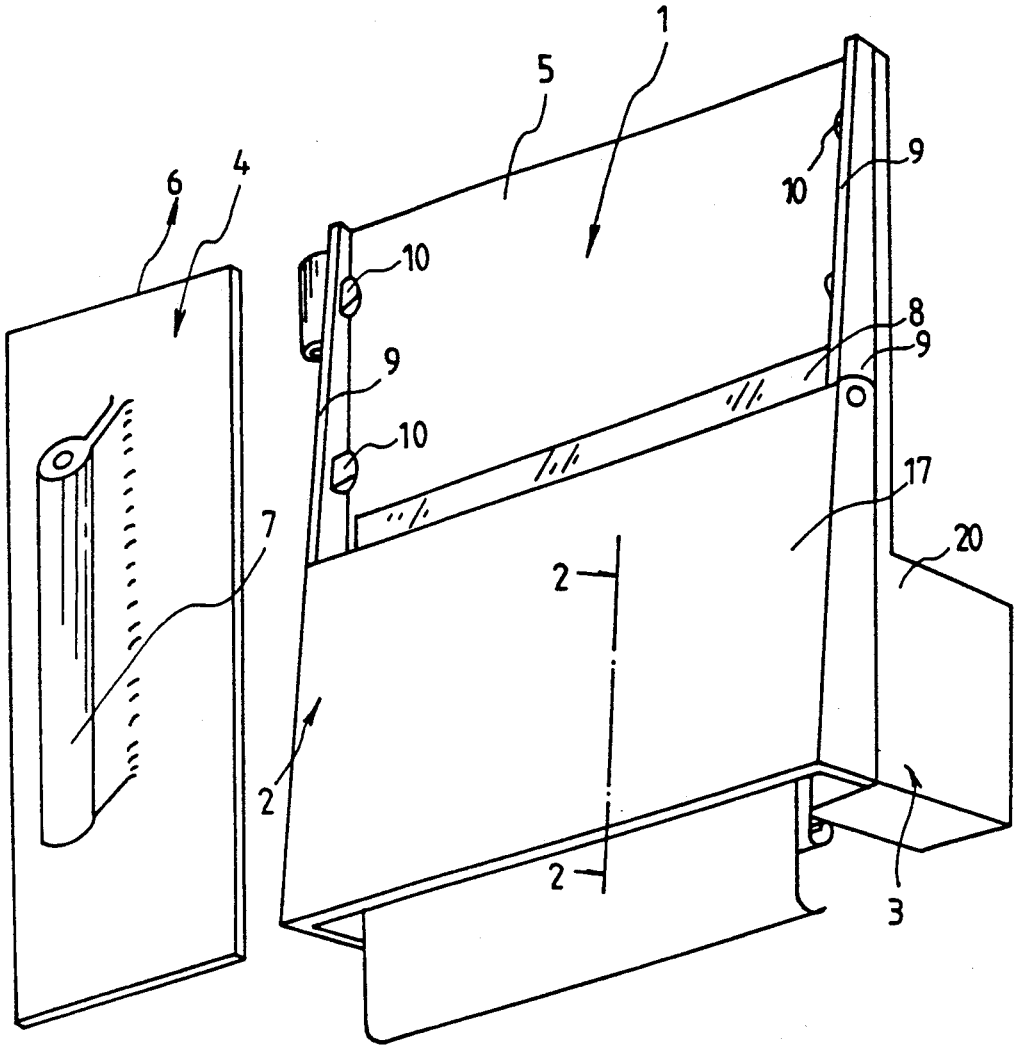
FIG. 2 shows a back view of the holder of the present invention.
Figure 3:
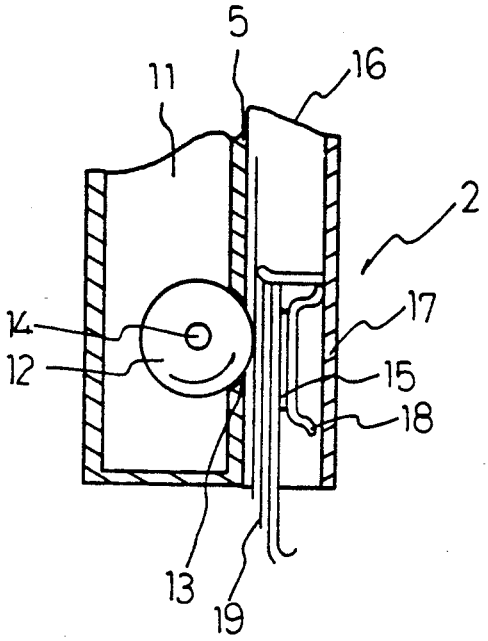
FIG. 3 is a partial cross-section taken along line 2—2 of FIG. 2.

Referring to FIG. 2 and FIG. 3, the present invention includes a main body 1, a paper delivery device 2, and a driving device 3. The main body 1 includes a base board 4 and a main board 5. The base board 4 includes double-sided tape on its back in order to fix the board 4 on the casing of a monitor. A pivotal shaft 7 protrudes from the upper side of the board 4, which is used with a spindle (not shown) to connect the base board 4 with the main board 5. The main board 5 is a flat board, having a transparent part 8 or an empty space, under which two or more lines of the draft is exposed for operators to read and input data.

On either side of the transparent part 8, there is provided parallel back sidewalls 9. At the proper height inside the sidewalls, an inwardly protruding leading strip 10 forms an open space with the main board 5 for allowing the draft to pass between the board and monitor without being crumpled. The transparent part 8 includes two front sidewalls 11 set in parallel and a pick-up roller 12 connected therebetween. Part of roller 12 protrudes out of the transparent part 8 through a groove 13, into the main board 5, in order to fix and deliver draft paper clamped at main board 5. The shaft 14 of pick-up roller 12 protrudes out of the front sidewall 11 for connecting the roller to the driving device 3.

As shown in FIGS. 2 and 3, the paper delivery device 2 of the invention includes pick-up roller 12, pressing plat 15, separator 16 and covering plate 17. Covering plate 17 is connected between the two sidewalls 9. At the back side of plate 17 and opposite to the pick-up roller 12, a spring 18 contacts pressing plate 15. Pressing plate 15 can be made of rubber having a proper coefficient of friction for clamping two or more draft papers 19 between the pressing plate 15 and pick-up roller 12. A separator 16 is located at the front of the draft paper 19, as well as along one side thereof. As the pick-up roller 12 rotates, the first sheet of draft paper 19 will slowly be drawn upward by friction between the roller and paper, and the separator 16 will stop the second sheet of draft paper 19 from moving, thereby delivering one sheet of paper at a time.

Figure 4:
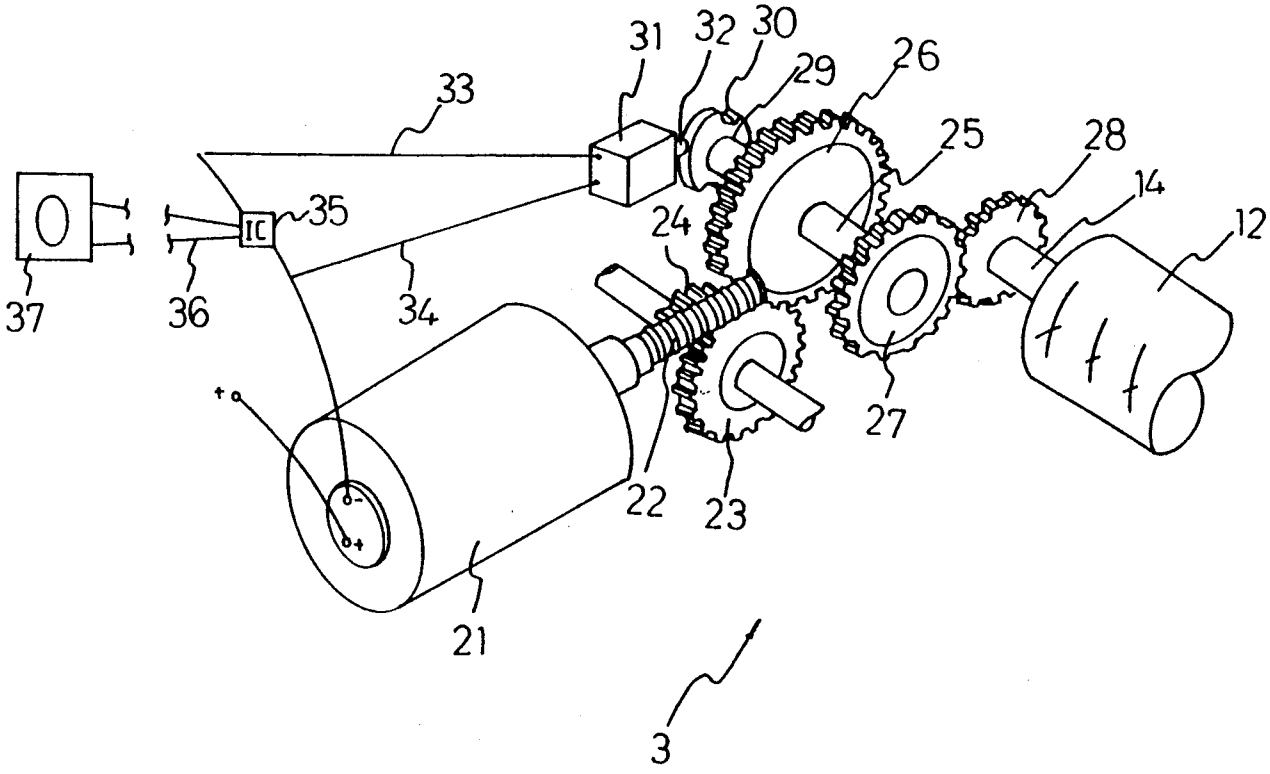
FIG. 4 shows a perspective view of the driving device, with the casing omitted.

As FIGS. 2 and 4 show, the driving device 3 of the invention is set on the front sidewall, inside a box or casing 20, and opposite to the protruding part of shaft 14 of pick-up roller 12. Box 20 has a small-sized motor 21 connected with a worm 22 at an output end thereof, and meshes with a worm-gear 23. Worm gear 23 pivotally combines with a speed-down drive pinion 24 meshed with a gear 26 of drive shaft 25. At one end, drive shaft 25 includes a drive gear 27 which meshes with a driven gear 28 set at one end of shaft 14 of pick-up roller 12. Another end of drive shaft 25 is connected to a pressing wheel 29, which has a round shape and two cutouts 30 located at the ridge thereof for providing space for the button 32 of the microswitch 31 to protrude into the pressing wheel 29.

Figure 5:
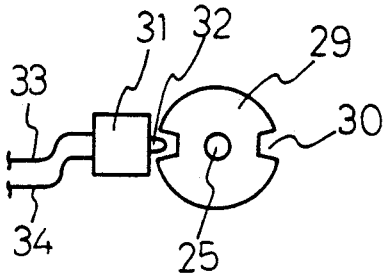
FIGS. 5 and 6 illustrate different positions of the pressing wheel of the present invention.
Figure 6:
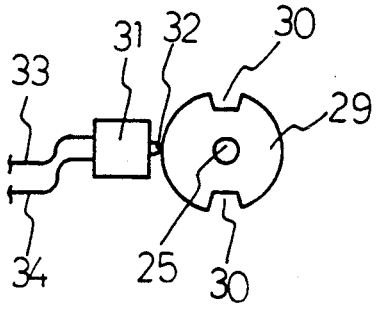

The microswitch 31 is shown in an 'OFF' state in FIG. 5. As the button 32 is pressed by the ridge of pressing wheel 29, the microswitch 31 will be activated in an 'ON' state, shown in FIG. 6.

A wire 33 of the microswitch 31 is linked to the negative pole of small-sized motor 21, while the other wire 34 is connected to the negative pole of a power supply. An IC 35 is installed between the two wires 33 and 34. IC 35 has two wires 36 and a button 37 is connected thereto. Button 37 can be set on a keyboard or nearby for the user's convenience.

When the invention is not used, the button 32 of microswitch 31 protrudes into cutout 30 of pressing wheel 29 (as shown in FIG. 5) and the circuit of the power supply of the motor is open. To activate, the operator needs only to touch the button 37, then, motor 21 starts by the short-time power supplied by IC 35, the pressing wheel 29 is driven and button 32 of microswitch 31 is removed from cutout 30. Meanwhile, the ridge of pressing wheel 29 pushes the button 32 to be in the 'ON' state in order to supply the power (shown in FIGS. 4 and 6). The other cutout 30 of pressing wheel 29 rotates to the opposite side of button 32 and releases the button into an 'OFF' state, to stop power to the motor 21. At this time, the drive pivot 25 has turned 180° and the drive gear 27, located above it, rotates the driven gear 28 along a half-circumference or 180°. Meanwhile, the pick-up roller 12 also turns, drawing the draft paper 19 out and upward by about the length of two or three lines and this length of the draft appears in the transparent part 8 of main body 1.

The above-mentioned cutouts 30 of pressing wheel 29 need not be limited to two, and can be a plurality provided, depending on the diameter of the pick-up roller 12 or the necessity of practical usage.

I claim:

1. A document and draft paper holder for a computer, comprising:

a main body including a base board and a main board, the main board including a transparent part for exposing a portion of the document;

means disposed on the base board for fixing the holder to a monitor oft he computer;

paper delivery means disposed on the main board for delivering the document to the transparent part of the main board, said paper delivery means including means for clamping the document to the main board; and driving means for driving the paper delivery means.

2. The document holder of claim 1, wherein the base board is pivotally connected to a side of the main board by a shaft.

3. The document holder of claim 1, wherein the main board includes a back surface and further comprising paper lifting means disposed to be lifted from the back surface of the main board to prevent the paper from being crumpled as the document is fed by the paper delivery means.

4. The document holder of claim 3, wherein the main board includes a pair of parallel back side walls and the paper lifting means comprises an inwardly protruding leading strip along each of said back side walls.

5. The document holder of claim 4, wherein the paper delivery means includes a cover plate disposed on the main board between the back sidewalls.

6. The document holder of claim 5, wherein said means for clamping the document to the main board comprises a pressing plate disposed between the cover plate and the main board for clamping one or more sheets of the document to the main board.

7. The document holder of claim 5, wherein said paper delivery means includes a separator in communication with the document and disposed between the main board and the cover plate, wherein as said pick-up roller rotates to deliver a sheet of the document, the separator prevent additional sheets from being delivered as well.

8. The document holder of claim 1, wherein the transparent part of the main board has a pair of front sidewalls, said paper delivery means including a pick-up roller disposed between the front sidewalls.

9. The document holder of claim 8, wherein a portion of the pick-up roller extends into the main board to engage and deliver sheets of the document clamped to the main board.

10. The document holder of claim 9, wherein the pick-up roller includes a shaft which protrudes from one of the front side walls for connecting the pick-up roller to the driving means.

11. The document holder of claim 10, wherein said driving means includes a motor driven drive shaft having opposed ends, one of the ends of the drive shaft combining with gear means for driving the shaft of the pick-up roller.

12. The document holder of claim 11, wherein the other end of the drive shaft includes a press-wheel having a plurality of cut-outs.

13. The document holder of claim 12, further comprising a switch for activating the paper delivery means, said switch including a button which extends into the cut-outs of the press-wheel, wherein when said switch is activated the drive shaft is driven to rotate the press-wheel and the pick-up roller to advance the portion of the document to the transparent part of the main board until the button engages one of the cut-outs and the switch is deactivated.

* * * * *